US008562103B2

(12) United States Patent
Nemoto

(10) Patent No.: US 8,562,103 B2
(45) Date of Patent: Oct. 22, 2013

(54) RECOVERY APPARATUS AND IMAGE FORMING APPARATUS

(75) Inventor: Yusuke Nemoto, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 105 days.

(21) Appl. No.: 13/227,694

(22) Filed: Sep. 8, 2011

(65) Prior Publication Data

US 2012/0062647 A1 Mar. 15, 2012

(30) Foreign Application Priority Data

Sep. 15, 2010 (JP) ..... 2010-206926

(51) Int. Cl.
*B41J 2/165* (2006.01)

(52) U.S. Cl.
USPC ..... 347/31; 347/29

(58) Field of Classification Search
USPC ..... 347/31
See application file for complete search history.

(56) References Cited

U.S. PATENT DOCUMENTS

| | | | | |
|---|---|---|---|---|
| 6,508,533 | B2 * | 1/2003 | Tsujimoto et al. | 347/29 |
| 2002/0130920 | A1 | 9/2002 | Saijo | |
| 2004/0027409 | A1 * | 2/2004 | Miyauchi | 347/31 |
| 2004/0252157 | A1 * | 12/2004 | Yamazaki et al. | 347/31 |
| 2009/0079786 | A1 * | 3/2009 | Watanabe et al. | 347/29 |
| 2009/0085964 | A1 * | 4/2009 | Ishimatsu et al. | 347/31 |
| 2009/0179928 | A1 | 7/2009 | Nemoto et al. | |
| 2010/0182370 | A1 | 7/2010 | Nemoto et al. | |
| 2012/0162310 | A1 * | 6/2012 | Okada | 347/29 |

FOREIGN PATENT DOCUMENTS

| | | | |
|---|---|---|---|
| EP | 510894 | A2 * | 10/1992 |
| JP | 11-138855 | | 5/1999 |
| JP | 11-170562 | | 6/1999 |
| JP | 2000-103072 | | 4/2000 |
| JP | 2007-144696 | | 6/2007 |

OTHER PUBLICATIONS

U.S. Appl. No. 13/040,437 of Yukihiro Asano et al., filed Mar. 4, 2011.

* cited by examiner

*Primary Examiner* — Shelby Fidler
(74) *Attorney, Agent, or Firm* — Cooper & Dunham LLP

(57) ABSTRACT

A recovery apparatus for recovering an ejection state of an ejection opening is disclosed. The recovery apparatus includes a cap member to seal an ejection surface of a droplet ejection head for ejecting a droplet from the ejection opening, and an absorber mounted in the cap member and to absorb ink attached to the ejection surface, so that the ink within a sealed space is suctioned and discharged. The absorber includes, when the ejection surface is sealed with the cap member, a first absorbing part to face the ejection surface at a first side where the ejection opening is provided through a first gap and a second absorbing part to face the ejection surface at a second side where the ejection opening is not provided through a second gap, wherein the first gap is greater than the second gap.

9 Claims, 8 Drawing Sheets

RECOVERY APPARATUS AND IMAGE FORMING APPARATUS

BACKGROUND OF THE INVENTION

1. Field of the Invention

The present invention is related to a recovery apparatus of an ink discharge part and an image forming apparatus.

2. Description of the Related Art

Conventionally, an inkjet-type image forming apparatus has been known in which a nozzle surface forming multiple ejecting openings on an ejecting surface of a droplet discharge head of the inkjet discharge part is faced downward, and an ink droplet is dropped on a recording medium opposed to the nozzle surface from the multiple ejecting openings. In this inkjet-type image forming apparatus, an ink solvent is vaporized from the ejecting opening, an ink viscosity around the ejecting opening is increased, and foreign matter such as paper particles and dust are attached at the ejecting opening. Accordingly, clogging is occurred, and an ink ejection can not be normally performed, whereby a defective image may be caused.

Consequently, the following image forming apparatus has been known. An image forming apparatus includes a recovery apparatus which recovers an ink ejecting function by suctioning dust and the like attached to the ejecting opening with ink. The recovery apparatus includes a cap member to cover the nozzle surface from underneath. At an upper portion of the cap member, a concave space which opens upward is formed. The opening due to the concave space has the size to cover an area on which the multiple ejecting openings are formed on the nozzle surface. At a bottom portion of the concave space, which faces the nozzle surface through the opening, a suction hole is formed. The suction hole is connected to a suctioning pump as a suctioning part. Also, the recovery apparatus includes a contact-separation part which moves the cap member between a first location where an opening end face around the opening is adhered to the nozzle surface to seal the area and a second location where the cap member is moved away from the first location and the nozzle surface is released.

In order to recover the ink ejecting function by the recovery apparatus having the above-described configuration, in a state in which the opening edge face is coherent to the nozzle surface and the area is sealed, the air of an internal space formed by the nozzle surface and the concave space of the cap member is suctioned by the suctioning pump. The foreign matters such as the dust attached to the ejecting opening and the like are forcibly suctioned and ejected with the ink from the ejection opening, whereby the ink ejecting function is recovered.

In the above configuration, a recovery apparatus disclosed in Japanese Laid-open Patent Publication No. 2007-144696 (hereinafter, called Patent Document 1) has been known. In an inkjet recording apparatus disclosed in Patent Document 1, a contact absorber and an elastic absorber are provided inside the concave space of the cap member to cohere the ejecting surface. The contact absorber is used to absorb ink on the ejecting surface by contacting the ejecting surface other than an area on which the ejecting opening is provided, when the opening edge face of the cap member is cohered to the ejecting surface to seal an internal portion of the cap member. The elastic absorber is used to apply pressure to the contact absorber so that the contact absorber is pressed with a moderate press contact force. In a state of being provided in the concave space of the cap member in a two layer structure layering these two absorbers, an upper surface of the contact absorber contacting the ejecting surface is ejected toward the ejecting surface from the opening edge face of the cap member and a face height difference exists.

When the internal portion of the cap member is sealed by making the opening edge surface of the cap member cohere to the ejecting surface, the contact absorber is pressed from the ejecting surface, and is pressed inside the cap member to pass a pushing force from the ejecting surface to the elastic absorber, due to the face height difference. Then, the contact absorber, which is provided at a location opposed to the ejecting surface other than the area on which the ejecting opening is provided, is pressed into contact with to the ejecting surface with a moderate press contact force by pressure from the elastic absorber which rebels the pushing force from the ejecting opening. Therefore, it is possible to prevent exceeding the press contact force for a contact between the ejecting surface and the contact absorber, whereby a contact surface is prevented from being damaged.

However, in Patent Document 1, when the cap member is cohered to the ejecting surface, it is required to press the contact absorber with the surface height difference inside the cap member. Also, it is required to successively press the cap member to the ejecting surface with a pushing force more than an elastic force of the elastic absorber. Furthermore, it is required to maintain this state until the ink and the like are suctioned and ejected. Due to a change over time in the above-described configuration, it becomes difficult to maintain and assure a sealed state, and the inside of the cap member can not be firmly sealed. Thus, there is a problem in which a suction defect is caused in a recovery process.

SUMMARY OF THE INVENTION

In one aspect of this disclosure, there is provided a recovery apparatus for recovering an ejection state of an ejection opening, including a cap member configured to seal an ejection surface of a droplet ejection head for ejecting a droplet from the ejection opening; and an absorber configured to be mounted in the cap member and to absorb ink attached to the ejection surface, so that the ink within a sealed space is suctioned and discharged, the absorber including: when the ejection surface is sealed with the cap member, a first absorbing part configured to face the ejection surface at a first side where the ejection opening is provided through a first gap; and a second absorbing part configured to face the ejection surface at a second side where the ejection opening is not provided through a second gap, wherein the first gap is greater than the second gap.

In another aspect of this disclosure, there is provided an image forming apparatus for forming an image by using a droplet ejection head which ejects a droplet from an ejection opening, comprising a recovery apparatus for recovering an ejection state of the ejection opening by sealing an ejection surface of the droplet ejection head, with a cap member internally mounting an absorber for absorbing ink attached to the ejection surface, and suctioning and discharging the ink within a sealed space, wherein the absorber is mounted in the cap member, and includes, when the ejection surface is sealed with the cap member, a first absorbing part configured to face the ejection surface at a first side where the ejection opening is provided through a first gap; and a second absorbing part configured to face the ejection surface at a second side where the ejection opening is not provided through a second gap, wherein the first gap is greater than the second gap.

BRIEF DESCRIPTION OF THE DRAWINGS

In the following, embodiments of the present invention will be described with reference to the accompanying drawings.

DESCRIPTION OF THE PREFERRED EMBODIMENTS

In the following, an embodiment according to the present invention will be described with reference to the accompanying drawings.

Figure 1:
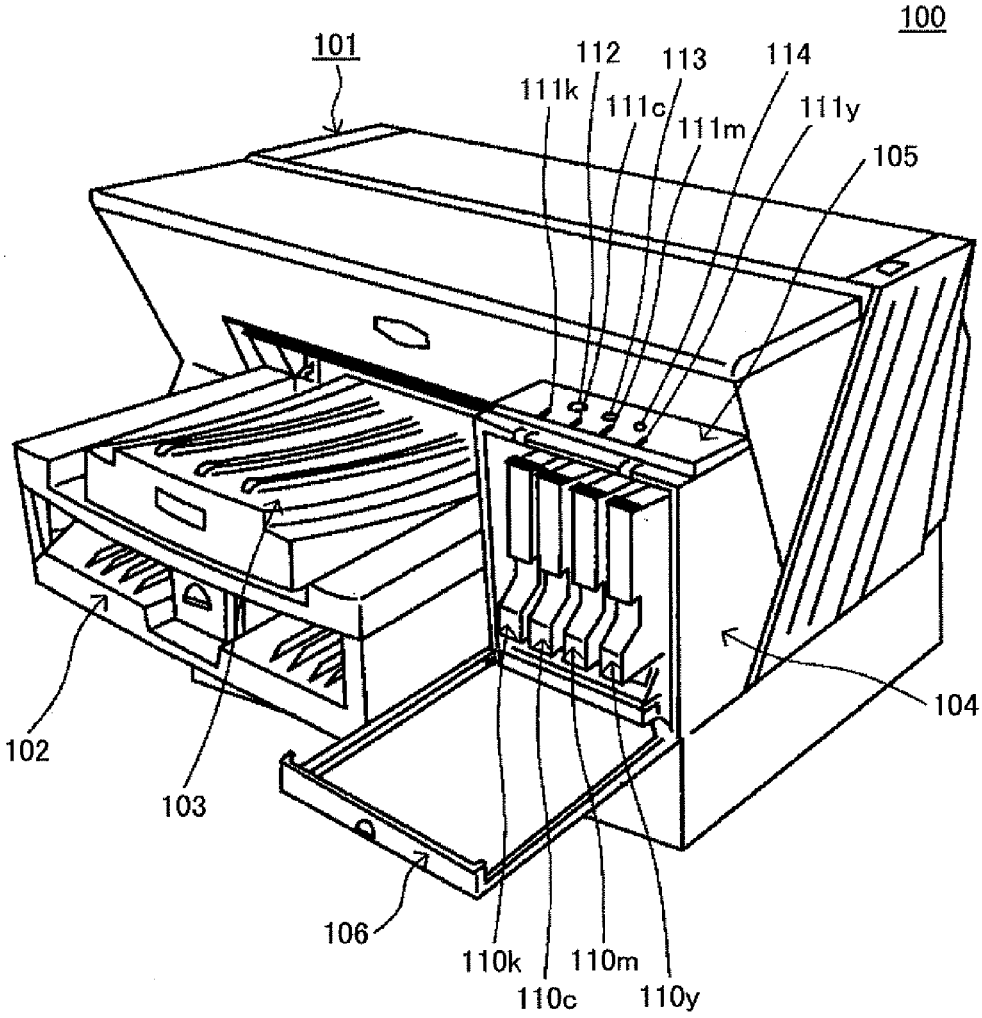
FIG. 1 is a perspective view from a front of a droplet ejecting apparatus as an image forming apparatus of an embodiment.

FIG. 1 is a perspective view from a front of a droplet ejecting apparatus as an image forming apparatus of an embodiment. A droplet ejecting apparatus 100 as the image forming apparatus illustrated in FIG. 1 includes a main body 101, a paper feed tray 102 which is mounted to the main body 101 to load a paper to the main body 101, and a paper ejection tray 103 which is detachably mounted to the main body 101 and stocks papers on which an image is recorded (formed). Also, the droplet ejecting apparatus 100 includes a cartridge loading part 104 at an edge side (lateral sides of the paper feed tray 102 and the paper ejection tray 103) of a front surface of the main body 101. The cartridge loading part 104 is ejected ahead from the front surface of the main body 101, and loads an ink cartridge located lower than an upper surface of the main body 101. On an upper surface of the cartridge loading part 104, an operation-display part 105, which includes an operation button, a display device, and the like, is provided.

In the cartridge loading part 104, ink cartridges 110*k*, 110*c*, 110*m*, and 110*y* for recording liquid (ink) as color materials of different colors are inserted and mounted from a front surface side toward a rear side of the main body 101. For example, the ink cartridges 110*k*, 110*c*, 110*m*, and 110*y* (if colors are not respectively distinguished, simply called "cartridges 110") may correspond to multiple recording liquid storage containers for containing a black (K) ink, a cyan (C) ink, a magenta (M) ink, and a yellow (Y) ink, respectively. At a front side of the cartridge loading part 104, a front cover (cartridge cover) 106 is provided and is possible to be opened and closed. The front cover 106 is opened when the ink cartridges 110 are mounted and removed. Also, the ink cartridges 110*k*, 110*c*, 110*m*, and 110*y* are formed so as to be arranged in a lateral direction in a vertically placed state and loaded to the cartridge loading part 104.

Moreover, remaining amount display parts 111*k*, 111*c*, 111*m*, and 111*y* for respective colors are arranged at arrangement locations corresponding to mounting locations (arrangement locations) of the ink cartridges 110*k*, 110*c*, 110*m*, and 110*y* at the operation-display part 105, to display information indicating a nearly end or an end of remaining amounts of the ink cartridges 110*k*, 110*c*, 110*m*, and 110*y*. Moreover, at the operation-display part 105, a power button 112, a paper feed-print restart button 113, and a cancel button 114 are arranged at the operation-display part 105.

Figure 2:
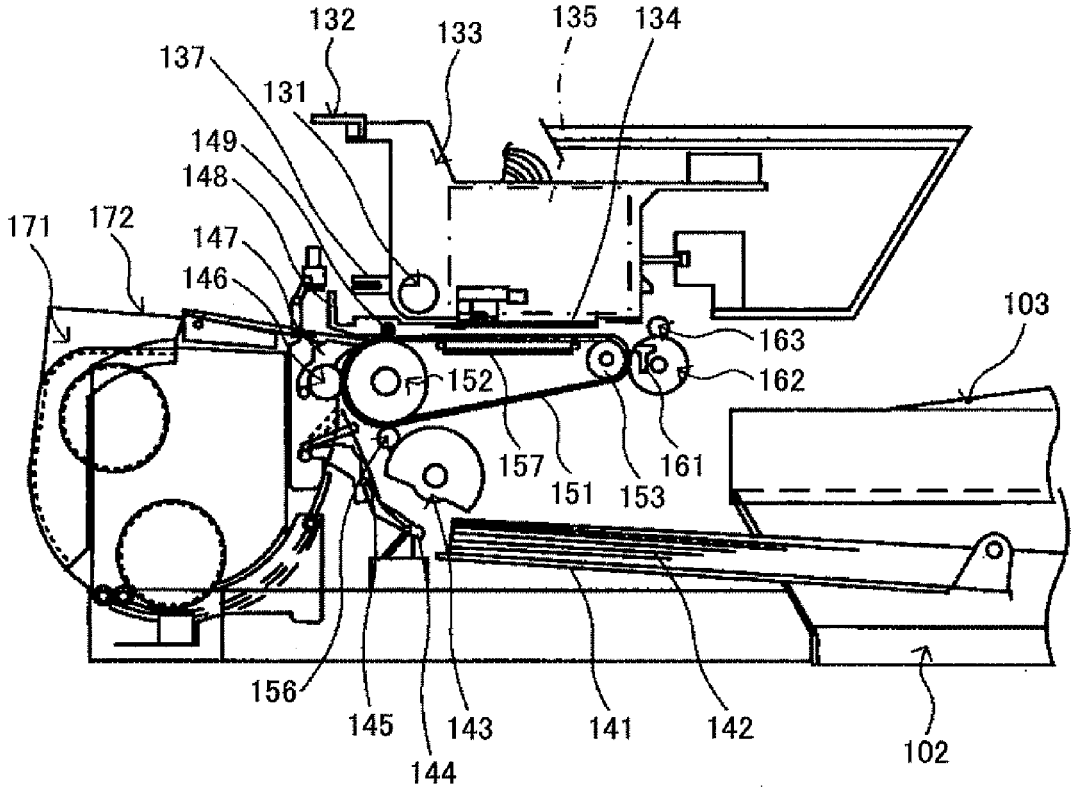
FIG. 2 is a lateral view illustrating a brief configuration of a mechanical part of the droplet ejecting apparatus.
Figure 3:
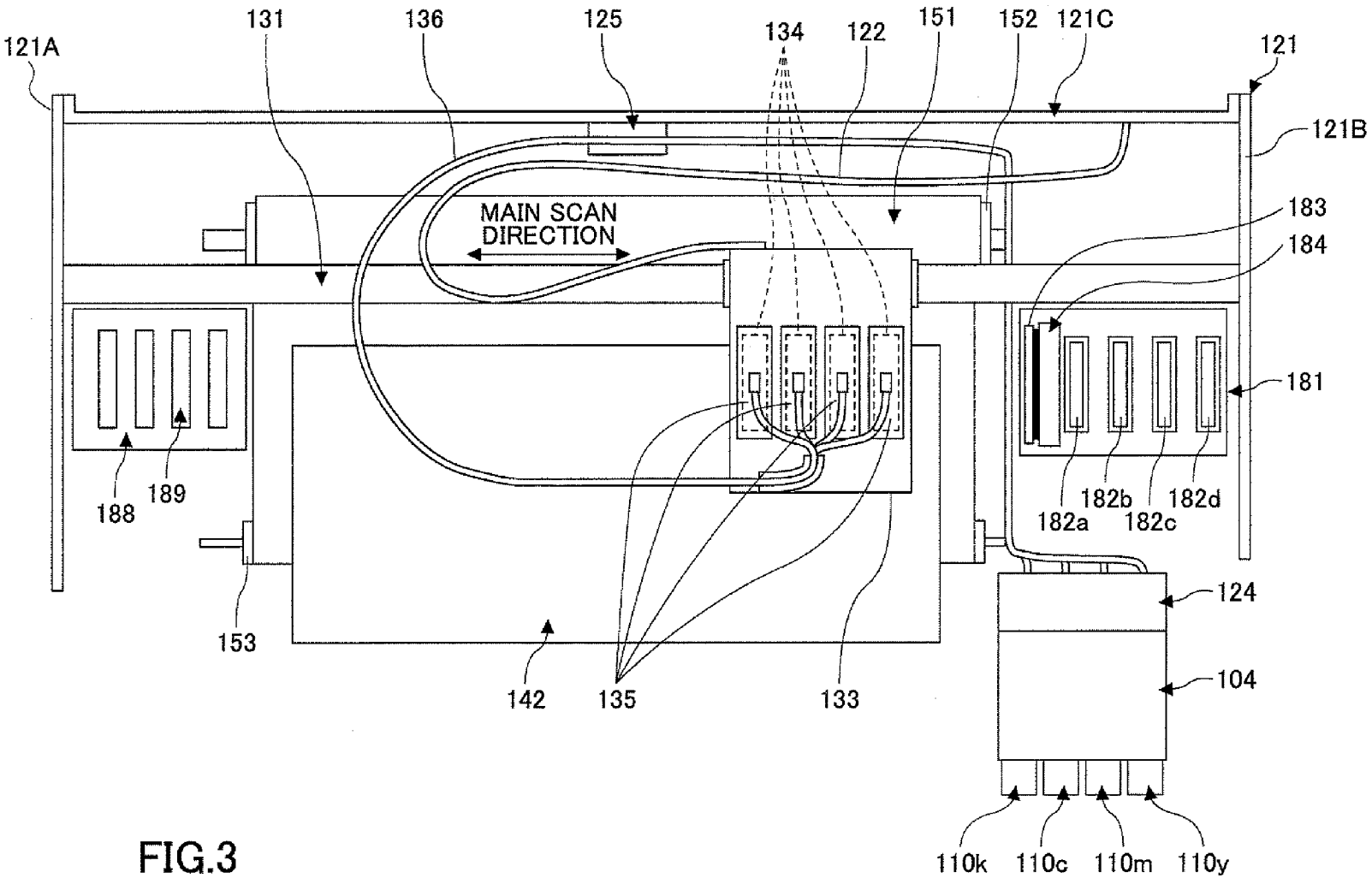
FIG. 3 is a plan view illustrating main parts in the mechanical part of the droplet ejecting apparatus.

Next, mechanical parts of the droplet ejecting apparatus 100 will be described with reference to FIG. 2 and FIG. 3. FIG. 2 is a lateral view illustrating a brief configuration of the mechanical parts of the droplet ejecting apparatus 100, and FIG. 3 is a plan view illustrating main parts in the mechanical parts of the droplet ejecting apparatus 100.

In the mechanical parts of the droplet ejecting apparatus 100, a carriage 133 is held slidably in a main scan direction by a guide rod 131 and a stay 132 which are guide members bridging lateral boards 121A at a left side and a lateral board 121B at a right side, thereby forming a frame 121. The carriage 133 is moved in the main scan direction indicated by an arrow in FIG. 3, through a timing belt by a main scan motor which is not illustrated.

In the carriage 133, four droplet ejection heads 134 eject ink droplets of respective color of yellow (Y), cyan (C), magenta (M), and black (Bk) as described above, and are arranged so that multiple ejecting openings are positioned in a direction crossing the main scan direction. The four droplet ejection heads 134 are mounted so that an ink droplet ejecting direction is directed downward.

To form each of the droplet ejection heads 134, an inkjet head may be used including a piezoelectric actuator such as a piezoelectric element, a thermal actuator using a phase change due to a film boiling of a liquid body by using an electrothermal conversion element such as a heat resistor, an actuator of a shape memory alloy using a metal phase change due to a temperature change, an electrostatic actuator using an electrostatic force, and the like, as a pressure generating part for generating pressure to eject an droplet.

A driver IC is mounted in each of the droplet ejection heads 134. Each of the droplet ejection heads 134 is connected to a control part (not shown) through a harness (flexible print cable) 122. Also, in the carriage 133, sub-tanks 135 for respective colors are mounted to supply respective inks to the droplet ejection heads 134. As described above, color inks are supplied to replenish the sub-tanks 135 for respective colors from the ink cartridges 110 through ink supply tubes 136 for respective colors. In the cartridge loading part 104, a supply pump unit 124 is provided to feed ink from the ink cartridges 110. The ink supply tubes 136 are supported by a locking member 125 of a rear board 121*c* forming the frame 121, in a middle of being placed around the main scan direction.

On the other hand, to feed sheets 142 accumulated on a sheet accumulation part (pressure board) 141 of the paper feed tray 102, a separation pad 144 is provided as a paper feeding part. The separation part 144 is opposed to a half-moon roller (paper feeding roller) 143 which separately feeds the sheets 142 one by one from the sheet accumulation part 141, and has a material quality of a friction coefficient. The separation pad 144 is urged to the half-moon roller (paper feeding roller) 143.

Also, to convey the sheets 142 fed from the paper feeding part below the droplet ejection heads 134, in addition to a guide member 145 guiding the sheets 142, a counter roller 146, a conveyance guide member 147, and a pressing member 148 including an edge pressure roller 149, a conveying belt 151 is provided as a conveying part for electrostatically attracting the sheets 142 being fed from the paper feeding part and conveying the sheets 142 to a location facing the droplet ejection heads 134.

The conveying belt 151 is an endless belt stretched around a conveying roller 152 and a tension roller 153 so as to form around a belt conveying direction (sub-scan direction). Also, an electrostatic roller 156 is provided as an electrostatic part for charging a surface of the carrying belt 151. The electrostatic roller 156 contacts a surface layer of the conveying belt 151, and is arranged to be rotated following a rotation of the conveying belt 151. Furthermore, a guide member 157 is arranged corresponding to a print area for the droplet ejection heads 134.

The conveying roller 152 is rotated by a sub-scan motor (not shown) with timing, and then, the conveying belt 151 is moved and turned round a belt conveying direction in FIG. 3.

Furthermore, a separation claw 161 for separating the sheets 142 from the conveying belt 151, and ejection rollers 162 and 163 are provided as an ejection part for ejecting the sheets 142 recorded by the droplet ejection heads 134. In addition, the paper ejection tray 103 is provided below the ejection roller 162.

Moreover, a double-side unit 171 is detachably mounted at a rear of the main body 101. The double-side unit 171 takes and turns over the sheets 142 being returned due to a rotation in a reverse direction of the carrying belt 151, and supplies the sheets 142 between the counter roller 146 and the carrying belt 151. An upper surface of the double-side unit 171 is used as a manual paper feed tray 172.

Furthermore, as illustrated in FIG. 3, in a non-print area at one side of the main scan direction of the carriage 133, a state of nozzles of the droplet ejection heads 134 is maintained and a maintenance recovery mechanism 181 including a recovery part for recovering the state of nozzles.

The maintenance recovery mechanism 181 includes cap members (hereinafter, called "caps") 182*a*, 182*b*, 182*c*, 182*d* (if caps are not respectively distinguished, simply called "caps 182") for capping each of nozzle surfaces of the droplet ejection heads 134, a wiper blade 183 regarded as a blade member for wiping the nozzle surfaces, and an idle ejection receiver 184 for receiving a droplets in an idle ejection for ejecting an droplet which is not used for a record, to discharge a recording droplet being thickened. The cap 182*a* is used as a cap to suction and moisturize, and other caps 182*b*, 182*c*, and 182*d* are used as caps to moisturize.

Waste liquid of the recording droplet produced by a maintenance recovery operation of the maintenance recovery mechanism 181, ink discharged to the caps 182, ink removed by a power cleaner 185 attached with the wiper blade 183, and ink ejected by the idle ejection receiver 184 are discharged and accommodated in a discharge tank which is not shown.

Moreover, as illustrated in FIG. 3, in another non-print area at another side of the main scan direction of the carriage 133, an idle ejection receiver 188 is arranged to receive a droplet not used for the record and being ejected by the idle ejection to eject the record droplet being thickened during the record. The idle ejection receiver 188 includes openings 189 each having a shape along a nozzle line direction of the droplet ejection heads 134.

In the droplet ejecting apparatus 100, the sheets 142 are separately fed one by one from the paper feed tray 102. Each of the sheets 142 fed to approximately vertical upper direction is guided by the guide member 145, and is conveyed by being sandwiched between the conveying belt 151 and the counter roller 146. Furthermore, each edge of the sheets 142 is guided by a conveying guide 147, and is pressed to the conveying belt 151 by the edge pressure roller 149. Then, each of the sheets 142 is commutated at approximately 90 degrees.

The electrostatic roller 156 is charged from a high-voltage power supply by a control circuit which is not shown in which a plus output and a minus output are alternated. That is, an alternating voltage is applied to the electrostatic roller 156. Thus, the conveying belt 151 is charged in an alternating charge voltage pattern. That is, the conveying belt 151 is charged alternately with plus and minus voltages in a belt-form with a predetermined width in the sub-scan direction which is a peripheral rotation direction. When each of the sheets 142 is fed onto the conveying belt 151 being applied alternately plus and minus voltages, each of the sheets 142 is suctioned on the conveying belt 151, and is conveyed in the sub-scan direction by a movement of the peripheral rotation of the conveying belt 151.

Then, the droplet ejection heads 134 are driven in response to an image signal while moving the carriage 133 in the main scan direction based on main scan location information by a linear encoder 137, so that one line is recorded by ejecting an ink droplet on each of the sheets 142 being stopped. After each of the sheets 142 is conveyed for a predetermined distance, a next line is recorded. In response to a record end signal or a signal received when a rear edge of each of the sheets 142 arrives at a recording area, a recording operation ends and each of the sheets 142 are ejected to the paper ejection tray 103.

Also, in a print (record) waiting, the carriage 133 is moved to a side of the maintenance recovery mechanism 181, and the droplet ejection heads 134 are capped with the caps 182. Accordingly, it is possible to prevent from ejection defect caused by inks being dried, by maintaining the nozzles in a wet condition. Moreover, the recording liquid is suctioned from the nozzles by a suctioning pump which is not shown, in a state of capping the droplet ejection heads 134 with the caps 182 (called "nozzle suction" or "head suction"). Then, a recovery operation is conducted to discharge the recording liquid being thickened along with air bubbles. In addition, before a record is begun, in a middle of recording, or the like, an idle ejection operation is conducted to eject inks not related to the record. Accordingly, an ejection performance of the droplet ejection heads 134 is stably maintained.

Figure 4:
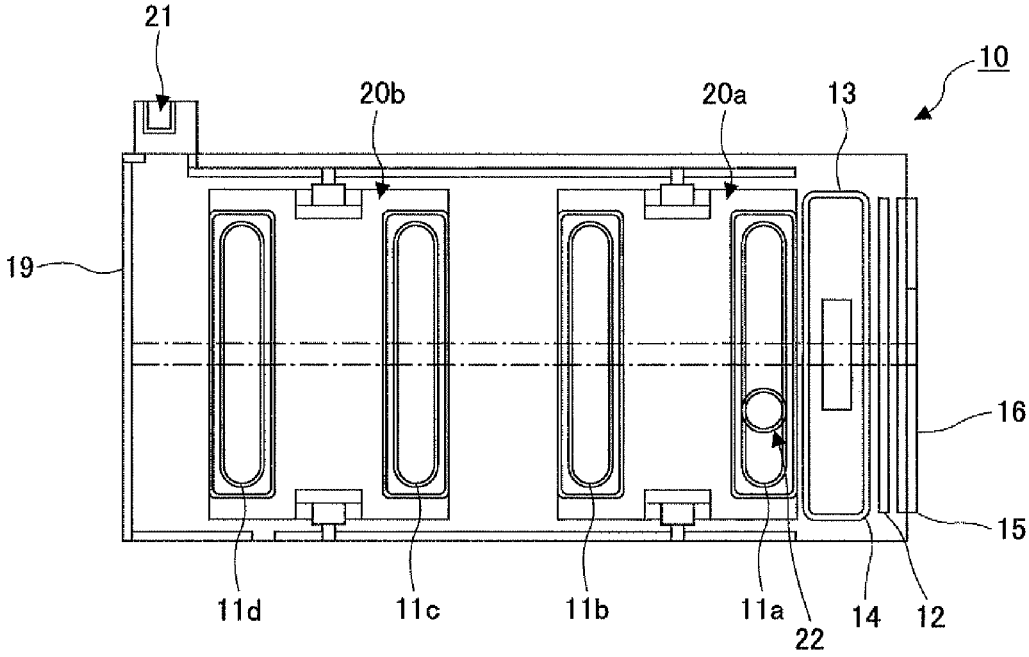
FIG. 4 is a plan view illustrating main parts of a recovery apparatus.
Figure 5:
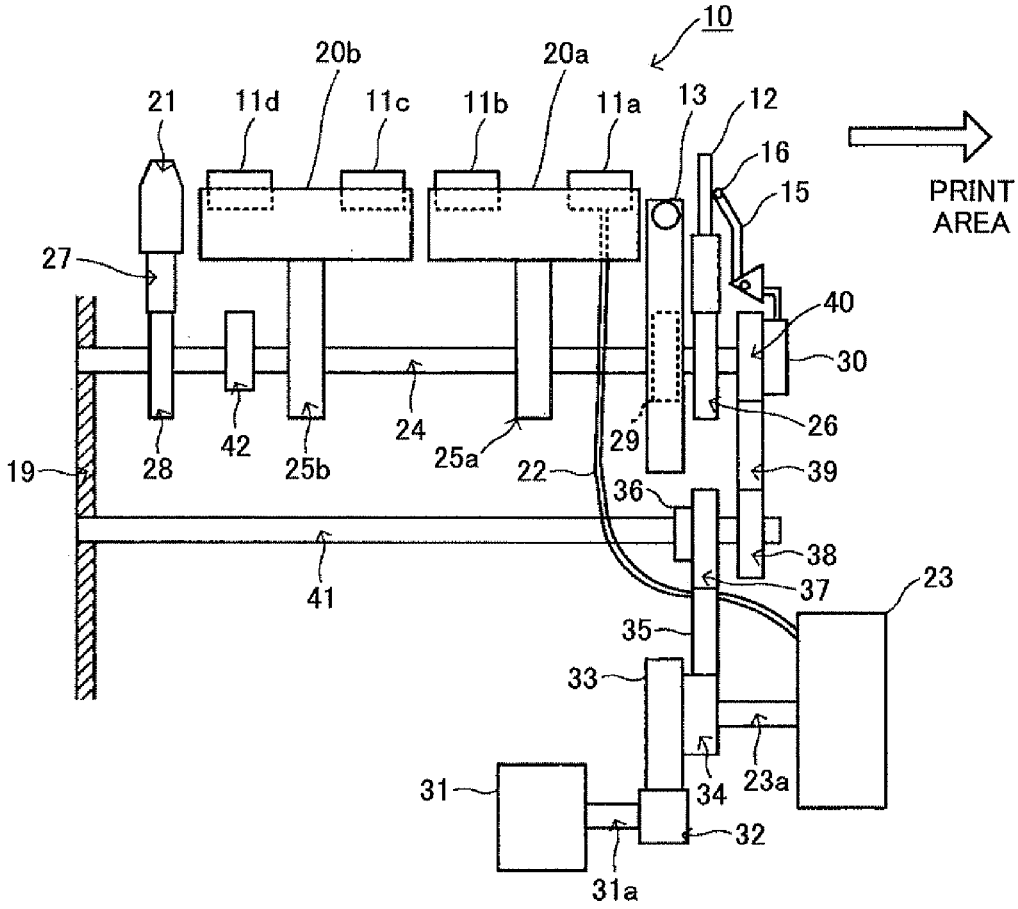
FIG. 5 is a schematic lateral view illustrating a mechanical configuration of the recovery apparatus.

A configuration of a recovery apparatus 10 will be briefly described with reference to FIG. 4 and FIG. 5. FIG. 4 is a plan view illustrating main parts of the recovery apparatus 10, and FIG. 5 is a schematic lateral view illustrating a mechanical configuration of the recovery apparatus 10.

In FIG. 4, at a frame 19 in the recovery apparatus 10, two cap holders 20*a* and 20*b*, a wiper blade 12, and a carriage lock 21 are retained so as to be possible to be elevated (lifted and lowered). The cap holders 20*a* and 20*b* (if cap holders are not respectively distinguished, called "cap holders 20") are regarded as a cap retaining mechanism. The wiper blade 12 is formed by a wiping member including an elastic body and is regarded as a cleanup part. Also, an idle ejection receiver 13 is arranged between a wiper blade 12 and the cap holder 20*a*. In order to clean the wiper blade 12, a wiper cleaner 14 including a cleaner roller is retained so as to be possible to swing. The wiper cleaner 14 including the cleaner roller is regarded as a cleaning member for the idle ejection receiver 13. The cleaner roller is used to press the wiper blade 12 toward the wiper cleaner 14 from outside of the frame 19. Also, the cap holder 20*a* retains two cap members 11*a* and 11*b* for capping the nozzle surfaces of two droplet ejection heads, and the cap holder 20*b* retains two cap members 11*c* and 11*d* for capping the nozzle surfaces of two droplet ejection heads 134.

The cap member 11*a*, which is the nearest the print area and held by the cap holder 20*a*, is connected to a tubing pump (suction pump) 23 regarded as a suction part through a flexible tube 22. The cap members 11*b*, 11*c*, and 11*d* other than the cap member 11*a* are not connected the tubing pump 23. That is, the cap member 11*a* alone is used for suction (recovery) and moisture, and the cap members 11*b*, 11*c*, and 11*d* are simply used for moisture. Accordingly, when the recovery operation of the droplet ejection heads 134 is conducted, the droplet ejection heads 134 are selectively moved to a location where a capping can be conducted by the cap member 11*a* for the recovery operation.

Moreover, a camshaft 24 is supported by the frame 19 so as to be rotated below the cap holders 20*a* and 20*b*. The camshaft 24 is provided with cap cams 25*a* and 25*b*, a wiper cam 26, a carriage lock cam 28, a roller 29, and a cleaner cam 30. The cap cams 25*a* and 25*b* are used to elevate and lower the cap holders 20*a* and 20*b*. The wiper cam 26 is used to elevate and lower the wiper blade 12. The carriage lock cam 28 is used to elevate and lower the carriage lock 21 through a carriage lock arm 27. The roller 29 is used as a body of rotation being an idle ejection landing member on which a droplet ejected in the idle ejection receiver 13 lands. The cleaner cam 30 is used to oscillate a wiper cleaner 15.

The cap members 11 are elevated and lowered by the cap cams 25*a* and 25*b*. The wiper blade 12 is elevated and lowered by the wiper cam 26. In a case of elevating the wiper blade 12, the wiper cleaner 15 is forged on the wiper blade 12. By sandwiching and elevating the wiper blade 12 between a cleaner roller 16 of the wiper cleaner 15 and the idle ejection receiver 13, ink attached on the wiper blade 12 is wiped and dropped into the idle ejection receiver 13. The carriage lock 21 is urged upward (in a lock direction) by a compression spring which is not shown, and is elevated and lowered through the carriage lock arm 27 driven by the carriage lock cam 28.

In order to rotate the tubing pump 23 and the camshaft 24, a motor gear 32 provided with a motor shaft 31*a* of the motor 31 is engaged with a pump gear 33 provided with a pump shaft 23*a* of the tubing pump 23. Also, an intermediate gear 34 integrated with the pump gear 33 is engaged with another intermediate gear 37 with a one-way clutch 36 through another intermediate gear 35. Meanwhile, and an intermediate gear 38 coaxial to the intermediate gear 37 is engaged with a cam gear 40 fixed to the cam shaft 24 via an intermediate gear 39. It should be noted that the frame 19, which is a rotation shaft of the intermediate gear 37 with the one-way clutch 36 and the intermediate gear 38, retains an intermediate shaft 41 so as to rotate.

Moreover, the camshaft 24 is provided with a cam 42 having a home position sensor for detecting a home position. A home position lever (not shown) is activated when the home position sensor (not shown) provided in the recovery apparatus 10 detects that the cap members 11 are positioned at the lowest end. Then, the home position sensor is in an open state, and the home position of the motor 31 (other than the tubing pump 23) is detected. In a case in which power is ON, regardless of positions of the cap members 11 (cap holders 20), the cap members 11 (cap holders 20) are elevated and lowered, the positions are not detected until a movement starts. After the home position of the cap members 11 is detected (in a middle of elevation), the cap members 11 are moved for a determined distance to position at the lowest end. After that, a carriage is moved right to/from left to be back to a cap location after the position detection, and the droplet ejection heads 134 are capped.

Next, a configuration of the cap members 11 forming the recovery apparatus 10 in the embodiment will be described.

Figure 6A:
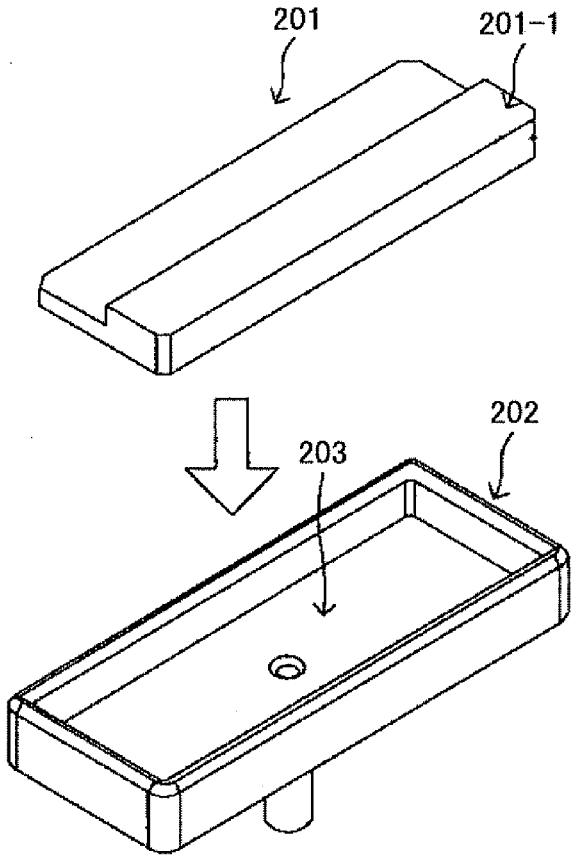
FIG. 6A and FIG. 6B are perspective views illustrating a configuration of each of cap members in the recovery apparatus in the embodiment.
Figure 6B:
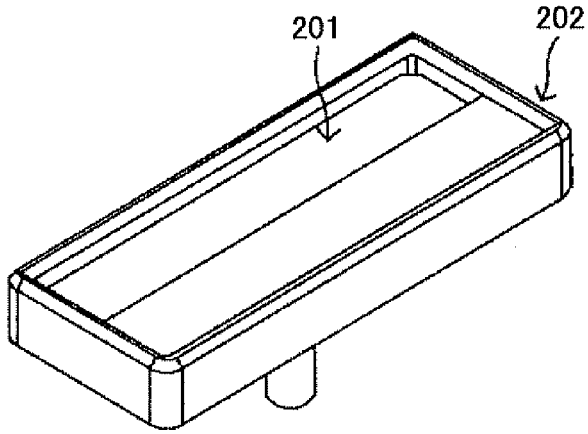

FIG. 6A and FIG. 6B are perspective views illustrating a configuration of each of the cap members in the recovery apparatus 10 in the embodiment. In FIG. 6A and FIG. 6B, each of the cap members 11 is illustrated as a cap member 202. As illustrated in FIG. 6A, an absorber 201 is provided with a concave space 203 of the cap member 202. In a sectional view in a shorter direction of the absorber 201, the absorber 201 includes a projected portion 201-1 close to an ejection surface, which is a part of an ejection surface of the droplet ejection heads 134 opposed thereto and is not provided with an ejection opening, through a gap. The absorber 201 having a cross-sectional shape as illustrated in FIG. 6A is accommodated in a concave space of the cap member 202. If the cap member 202 is contacted and pressed to an ejection surface, it may be difficult to assure a nip state of the cap member 202 concerning the ejection surface, and an absorption defect may be caused. To address this, the projected portion 201-1 of the absorber 201 forms a gap 201-2 (FIG. 7A) to prevent contact to the ejection surface when the cap member 202 is appressed to the ejection surface. The gap 201-2 (FIG. 7A) is formed to be smaller than a gap between the ejection surface and the absorber 201 facing the ejection surface on which the ejection opening is formed.

Next, the recovery operation conducted by the recovery apparatus 10 using the cap member 202 in the embodiment will be described with reference to FIG. 7A through FIG. 7E. In FIG. 7A through FIG. 7E, a recording head having one line of ejection openings is illustrated. However, it is not limited to this example, the embodiment can be applied to any other recording head having more than one line of ejection openings. Each of the droplet ejection heads 134 corresponds to a droplet ejection head 301.

Figure 7A:
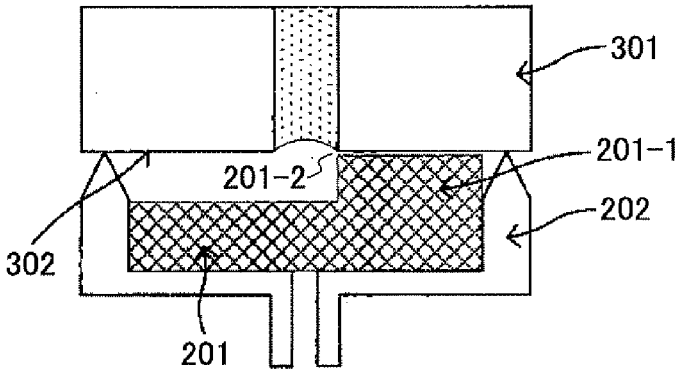
FIG. 7A through FIG. 7E are schematic cross-sectional views illustrating an recovery operation in the recovery apparatus in the embodiment.
Figure 7B:
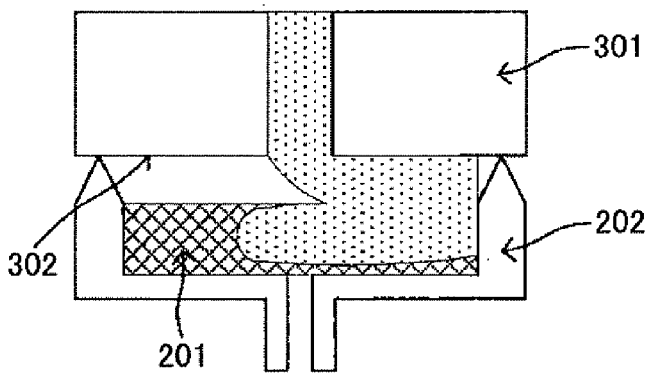

First, as illustrated in FIG. 7A, the cap member 202 is contacted to a droplet ejection head 301, and an ejection surface 302 is appressed to the cap member 202 to be sealed. Then, as illustrated in FIG. 7B, a suction part such as a suction pump or the like (not shown) suctions an internal space formed between the ejection surface 302 and the cap member 202. Ink ejected from an ejection opening 7*b* flows into the absorber 201 with the projected portion 201-1 of the absorber 201.

Figure 7C:
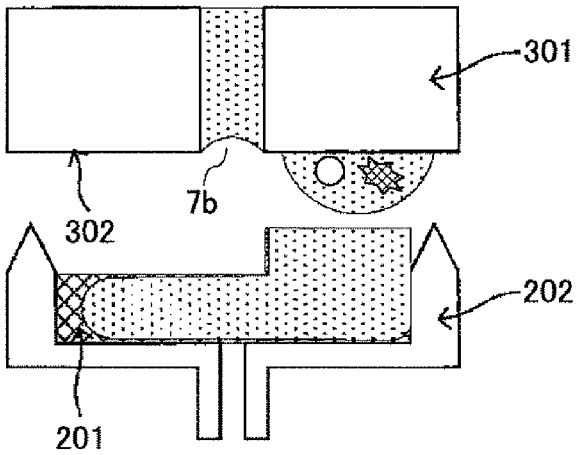
Figure 7D:
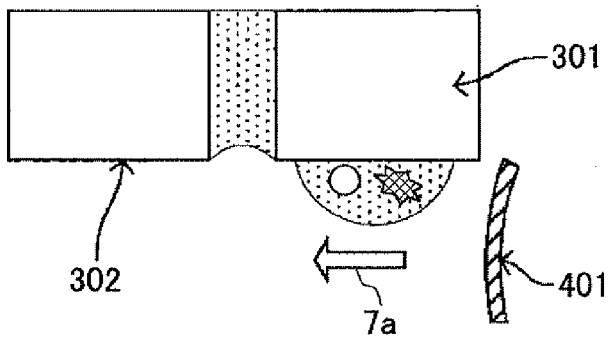
Figure 7E:
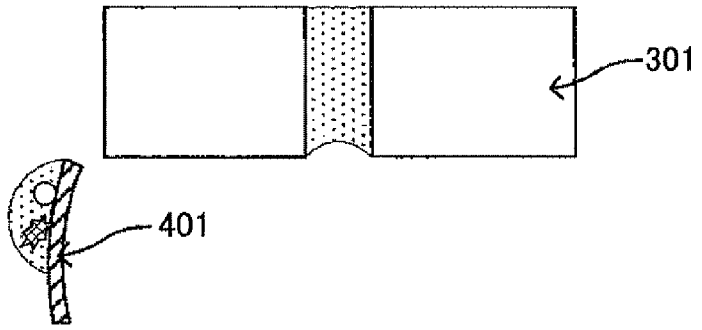

When the suction ends and the cap member 202 is separated from the droplet ejection head 301, as illustrated in FIG. 7C, ink inside the cap member 202 is separated to the ejection surface 302 and a surface of the absorber 201 inside the cap member 202, and ink is adhered to the ejection surface 302. A location where the ink is adhered faces the projected portion 201-1 of the absorber 201 closed to the ejection surface 302, so that the ink is not adhered in a vicinity of the ejection opening 7*b*. Accordingly, it is possible to suppress taking ink into the droplet ejection head 301 due to a negative pressure inside the droplet ejection head 301. Thus, as illustrated in FIG. 7D and FIG. 7E, foreign matter such as ink, paper particles, and the like remaining on the ejection surface 302 can be removed by pressing the wiper blade 401 to the ejection surface 302 and moving the wiper blade 401 in a direction indicated by an arrow 7*a*.

The projected portion 201-1 of the absorber 201 is located to be asymmetric with respect to the ejection opening 7*b*, and is arranged at an upstream in a wiping direction. By this configuration, remaining ink adhering to the ejection surface 302 can be used as an antifriction to wipe the ejection surface 302. By wiping the ejection surface 302, mist attached to the ejection surface 302 is dispersed. Also, the foreign matter such as paper particles are taken into and removed with wiping the ejection surface 302. Therefore, it is possible to improve cleanliness of the ejection surface 302. The absorber 201 is accommodated in the cap member 202 so as to arrange the projected portion 201-1 of the absorber 201 at the upstream in the wiping direction. Also, in the absorber 201, a portion of the gap formed with a part of the ejection surface 302 on which the ejection opening 7*b* is formed, when the cap member 202 seals the ejection surface 302. Furthermore, multiple projected portions may be provided and arranged to form steps. Thus, it is possible to improve absorbency of the absorber 201. Alternatively, the absorber 201 may be divided into multiple portions. In addition, each of divided multiple portions of the absorber 201 may be formed by different materials. Thus, it is possible to further improve the absorbency of the absorber 201.

As described above, in the embodiment, as illustrated in FIG. 6, the projected portion 201-1 is provided at a part of an upper surface of the absorber 201 facing the ejection surface other than an area facing the ejection opening 7*b*. As illustrated in FIG. 7A through FIG. 7E, the absorber 201 is formed, so that the cap 201-2 is formed between the projected portion 201-1 and the ejection surface 302 when the cap member 202 seals the ejection surface 302 of the droplet ejection head 301. The gap 201-2 is shorter than a gap between a portion of the absorber 201 facing the part of the ejection surface 302 providing the ejection opening 7*b* and the ejection surface 302. By this configuration, when the cap member 202 is appressed to the ejection surface 302, the nip state between the ejection surface 302 and the cap member 202 is assured and a sealed state is formed. Accordingly, it is possible to prevent an occurrence of an absorption defect.

Moreover, according to the embodiment, as illustrated in FIG. 7A through FIG. 7E, the projected portion 201-1 is provided at the upstream in a direction of the wiper blade 401 on a surface of the absorber 201 after the wiper blade 401 wiping the ejection surface 302 passes over the ejection opening 7*b*. Thus, the ink remaining on the ejection surface 301 is not taken into the ejection opening 7*b*, and is further used as the antifriction for wiping the ejection surface 301.

Furthermore, in the embodiment, the absorber 201 is formed by a porous material. Multiple projected portions are arranged so as to form steps. Furthermore, the absorber 201 is divided into multiple portions. Each of the multiple portions divided from the absorber 201 is formed by a different material. Accordingly, the absorber 201 can be improved to absorb the ink.

According to the present invention, an absorber mounted in a cap member includes a first absorbing part configured to face an ejection surface at a first side where an ejection opening is provided through a first gap, and a second absorbing part configured to face the ejection surface at a second side where the ejection opening is not provided through a second gap, when the ejection opening is sealed with the cap member. The first gap is greater than the second gap. Also, a height of the second gap is shorter than that of ink attached to the ejection surface, and the absorber contacts and absorbs the ink. Moreover, when the cap member is cohered to the ejection surface, due to the first and second gaps between the absorber and the ejection surface, the cap member can be adhered to the ejection surface without being pressed by the absorber. Thus, a nip state between the ejection surface and the cap member can be assured to form a sealed state. Accordingly, it is possible to prevent an occurrence of absorption defect in a recovery process.

The present invention is not limited to the specifically disclosed embodiments, and variations and modifications may be made without departing from the scope of the invention. Also, variations of the present invention may be formed by appropriately combining multiple functional elements disclosed in the above-described embodiments. For example, one or more functional elements may be deleted from the entire functional elements illustrated in the embodiments. Alternatively, functional elements are selected from different embodiments and appropriately combined.

The present application is based on Japanese Priority Patent Application No. 2010-206926 filed on Sep. 15, 2010, the entire contents of which are hereby incorporated by reference.

What is claimed is:

1. A recovery apparatus for recovering an ejection state of an ejection opening, comprising:

a cap member configured to seal an ejection surface of a droplet ejection head for ejecting a droplet from the ejection opening;

a blade for wiping the ejection surface of the droplet ejection head; and an absorber configured to be mounted in the cap member and to absorb ink attached to the ejection surface, so that the ink within a sealed space is suctioned and discharged, when the ejection surface is sealed with the cap member, the absorber including:

a first absorbing part configured to face a first portion of the ejection surface where the ejection opening is provided, through a first gap; and a second absorbing part including a projected portion projected upward, configured to face a second portion of the ejection surface where the ejection opening is not provided, through a second gap, wherein the first absorbing part and the second absorbing part are formed as one-body and having a stepwise shape, the first gap is greater than the second gap, each of the longitudinal direction of the blade and the cap member is arranged parallel with the ejection opening array direction, the blade wiping the ejection surface of the droplet ejection head along a moving direction perpendicular to the longitudinal direction of the ejection opening array direction, the projected portion is provided at an upstream side of the ejection opening array in the moving direction of the blade for wiping the ejection surface and no other projected portion is provided at a downstream side of the ejection opening array in the moving direction of the blade for wiping the ejection surface.

2. The recovery apparatus as claimed in claim 1, wherein the absorber is mounted in the cap member at an upstream location with reference to the moving direction of the blade for wiping the ejection surface after the blade passes the ejection opening.

3. The recovery apparatus as claimed in claim 1, wherein the absorber is formed from a porous material.

4. The recovery apparatus as claimed in claim 1, wherein the ejection opening array is disposed in a central portion of the ejection surface, with reference to the moving direction of the blade for wiping the ejection surface, a suction part is disposed in a central portion of the cap member, and an extent of the projected portion the moving direction of the blade is greater than a half-width of the second portion of the ejection surface which the projected portion faces.

5. The recovery apparatus as claimed in claim 1, wherein the projected portion of the second absorbing part is disposed and configured to permit remaining ink and foreign matters on the ejection surface to be drawn away from the ejection array opening.

6. The recovery apparatus as claimed in claim 1, wherein the projected portion of the second absorbing part is disposed asymmetrically, in the moving direction of the blade, relative to the ejection opening array.

7. The recovery apparatus as claimed in claim 1, wherein the second portion of the ejection surface which the projected portion faces is adjacent to the ejection opening.

8. The recovery apparatus as claimed in claim 1, wherein the second portion of the ejection surface which the projected portion faces is adjacent to the ejection opening, and the projected portion extends, in a direction parallel to the moving direction of the blade, from the ejection opening to a wall of the cap member.

9. An image forming apparatus for forming an image by using a droplet ejection head which ejects a droplet from an ejection opening, comprising:

a recovery apparatus for recovering an ejection state of the ejection opening by sealing an ejection surface of the droplet ejection head, with a cap member internally mounting an absorber for absorbing ink attached to the ejection surface and suctioning and discharging the ink within a sealed space, the recovery apparatus further including a blade for wiping the ejection surface of the droplet ejection head;

wherein the absorber is mounted in the cap member, and includes, when the ejection surface is sealed with the cap member, a first absorbing part configured to face a first portion of the ejection surface where the ejection opening is provided through a first gap; and a second absorbing part including a projected portion projected upward, configured to face a second portion of the ejection surface where the ejection opening is not provided, through a second gap, wherein the first absorbing part and the second absorbing part are formed as one-body and having a stepwise shape the first gap is greater than the second gap, each of the longitudinal direction of the blade and the cap member is arranged parallel with the ejection opening array direction, the blade wiping the election surface of the droplet ejection head along a moving direction perpendicular to the longitudinal direction of the ejection opening array direction, the projected portion is provided at an upstream side of the ejection opening array in the moving direction of the blade for wiping the ejection surface, and no other projected portion is provided at a downstream side of the ejection opening a in the moving direction of the blade for wiping the ejection surface.

* * * * *